US006913548B2

(12) United States Patent
Moriyama et al.

(10) Patent No.: US 6,913,548 B2
(45) Date of Patent: Jul. 5, 2005

(54) MULTI-PIECE SOLID GOLF BALL

(75) Inventors: Keiji Moriyama, Kobe (JP); Masaya Tsunoda, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/691,616

(22) Filed: Oct. 24, 2003

(65) Prior Publication Data

US 2004/0142767 A1 Jul. 22, 2004

(30) Foreign Application Priority Data

Oct. 25, 2002 (JP) ..... 2002-310784

(51) Int. Cl.[7] ..... A63B 37/04
(52) U.S. Cl. ..... 473/376
(58) Field of Search ..... 473/376, 377, 473/373, 374, 367, 368

(56) References Cited

U.S. PATENT DOCUMENTS 5,743,816 A * 4/1998 Ohsumi et al. ..... 473/376
5,772,531 A * 6/1998 Ohsumi et al. ..... 473/376
6,354,966 B1 3/2002 Takemura et al.
6,569,036 B1 * 5/2003 Takemura et al. ..... 473/376
6,626,770 B2 * 9/2003 Takemura et al. ..... 473/371
6,645,089 B2 * 11/2003 Tsunoda et al. ..... 473/371
2002/0019268 A1 * 2/2002 Tsunoda et al. ..... 473/351
2002/0042308 A1 * 4/2002 Tsunoda et al. ..... 473/351
2003/0109331 A1 * 6/2003 Sullivan et al. ..... 473/371

FOREIGN PATENT DOCUMENTS

JP 10-179798 A 7/1998
JP 11-267247 A 10/1999
JP 2001-87422 A 4/2001

* cited by examiner

*Primary Examiner*—Raeann Gorden
(74) *Attorney, Agent, or Firm*—Birch, Stewart, Kolasch & Birch, LLP

(57) ABSTRACT

The present invention provides a multi-piece solid golf ball having excellent flight performance and good shot feel. The present invention relates to a multi-piece solid golf ball comprising a core consisting of an inner core, an intermediate layer and an outer layer, and a cover, wherein the inner core has a flexural rigidity ($R_I$) of 20 to 80 MPa, a ratio ($R_M/R_I$) of a flexural rigidity of the intermediate layer ($R_M$) to the ($R_I$) is from 0.6 to 1.4, a flexural rigidity of the outer layer is higher than the ($R_I$) by 70 to 500 MPa, and the intermediate layer is placed such that the a radius of the golf ball ($r_G$), a radius of the inner core ($r_I$) and a radius of a two-layer structured core obtained by forming the intermediate layer on the inner core ($r_T$) satisfy the following two formulae:

$$r_I/r_G \geqq 0.70$$

$$r_T/r_G \leqq 0.83.$$

10 Claims, 1 Drawing Sheet

MULTI-PIECE SOLID GOLF BALL

This Nonprovisional application claims priority under 35 U.S.C. § 119(a) on Patent Application No(s). 2002-310784 filed in Japan on Oct. 25, 2002, the entire contents of which are hereby incorporated by reference.

FIELD OF THE INVENTION

The present invention relates to a multi-piece solid golf ball. More particularly, it relates to a multi-piece solid golf ball having high trajectory and excellent flight performance by accomplishing high launch angle and low spin amount, and having good shot feel.

BACKGROUND OF THE INVENTION

Launch angle and backspin of golf ball have a great effect on trajectory of the golf ball hit by a golf club. The hit golf ball having large launch angle tends to have high trajectory, and the hit golf ball having small launch angle tends to have low trajectory. Since the backspin provides lift to the hit golf ball, the hit golf ball having large backspin amount tends to have high trajectory, and the hit golf ball having small backspin amount tends to have low trajectory. Performance requirements of golf balls from golfers include flight distance, shot feel, controllability and the like. When golfers use a golf club, particularly wood club (such as a driver), long iron club, middle iron club and the like, the flight distance is an important performance requirement.

In order to improve the flight distance when hit by a golf club such as a wood club, it is required for the hit golf ball to have high trajectory and long flight duration to a certain extent as well known. The hit golf ball having large launch angle and large backspin amount has high trajectory as described above, but the hit golf ball having too large backspin amount tends to have short flight distance. It is reason that kinetic energy is consumed by backspin, and that force applied such that the hit golf ball is pulled backward occurs by the lift until the golf ball reaches the highest point of the trajectory because the lift is applied perpendicular to the flight direction of the golf ball. Therefore, golf ball, of which the backspin amount is not very large and high trajectory is accomplished by high launch angle, has long flight distance when hit by a golf club, such as a wood club.

The shot feel is also an important performance requirement. When the shot feel is too hard, the golf ball has too short contact time with a golf club even if the backspin amount is small, and golfer can not easily hit the golf ball. On the other hand, when the shot feel is too soft, golfer feels that the golf ball has poor shot feel such that rebound characteristics are poor.

Based on the above knowledge, there has been many developments of golf ball having long flight distance accomplished by low backspin amount and high launch angle at the time of hitting, and good shot feel, from the viewpoint of formulation of the material and structure of the golf ball (Japanese Patent Kokai Publication Nos. 179798/1998, 267247/1999, 87422/2001 and the like).

In Japanese Patent Kokai Publication No. 179798/1998, a four-piece solid golf ball comprising a core, an intermediate layer composed of an inner intermediate layer and an outer intermediate layer, and a cover covering the intermediate layer is disclosed. The center has a diameter of 15 to 25 mm and a JIS-C hardness of 65 to 80, the inner intermediate layer has a thickness of 2 to 13 mm and a JIS-C hardness of 70 to 85, the outer intermediate layer has a thickness of 1.3 to 2.5 mm and a JIS-C hardness of 40 to 80, and the cover has a thickness of 1.7 to 2.9 mm and a Shore D hardness of 62 to 72.

In Japanese Patent Kokai Publication No. 267247/1999, thermoplastic composition for golf ball comprising (A) 40 to 95% by weight of polyamide-based thermoplastic elastomer, (B) 5 to 60% by weight of polyester-based thermoplastic elastomer and (C) 1 to 10% by weight of core-shell type polymer containing at least one of epoxy group and carboxyl group as an outer number of total 100% by weight of the (A) and (B) and having a Shore D hardness within the range of 20 to 50 is disclosed.

In Japanese Patent Kokai Publication No. 87422/2001, a multi-piece solid golf ball comprising a core composed of an inner layer core and at least one layer of an outer layer core formed on the inner layer, and at least one layer of a cover formed on the core is disclosed. The inner layer core has an elastic modulus of 50 to 200 MPa, the outer layer core comprises at least one layer of a low elastic modulus layer having an elastic modulus lower than that of the inner layer core by 15 to 100 MPa, at least one layer of the lowest elastic modulus layer having the lowest elastic modulus in the core has a total thickness of 0.2 to 5.0 mm and is placed in a range of 6.5 to 20.5 mm away from the center point of the core, and the core has a diameter of 37 to 41 mm.

However, it has been required to provide golf balls, of which the flight distance and shot feel are improved still more. Therefore, there has been no golf ball, which is sufficient to the balance between excellent flight performance by accomplishing small backspin amount and high launch angle at the time of hitting, and good shot feel at the time of hitting.

OBJECTS OF THE INVENTION

A main object of the present invention is to provide a multi-piece solid golf ball having high trajectory and excellent flight performance by accomplishing high launch angle and low spin amount, and having good shot feel.

According to the present invention, the object described above has been accomplished by providing a multi-piece solid golf ball comprising a core consisting of an inner core, an intermediate layer and an outer layer, and a cover; and by adjusting the flexural rigidity of the inner core, the position of the intermediate layer and the flexural rigidity distribution in the core to specified ranges, thereby providing a multi-piece solid golf ball having high trajectory and excellent flight performance by accomplishing high launch angle and low spin amount, and having good shot feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
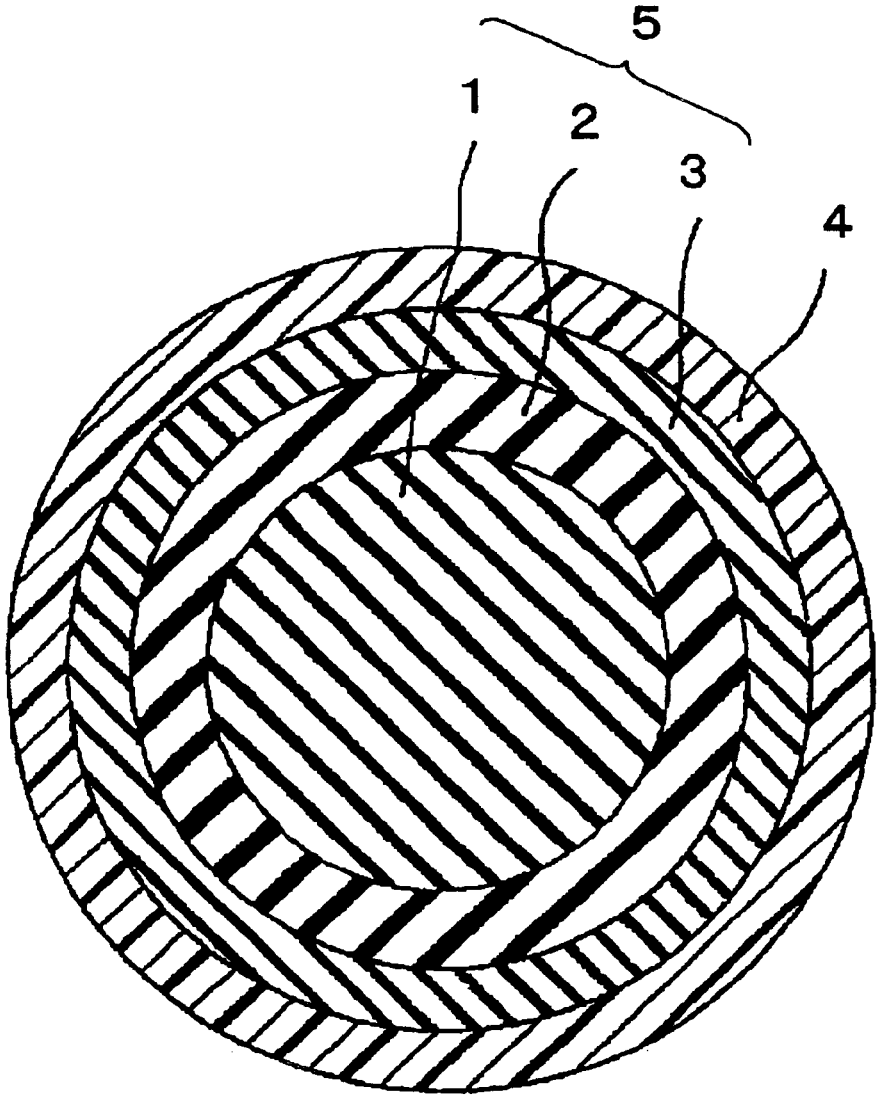
FIG. 1 is a schematic cross section illustrating one embodiment of the golf ball of the present invention.

The present invention provides a multi-piece solid golf ball comprising a core consisting of an inner core, an intermediate layer formed on the inner core and an outer layer formed on the intermediate layer, and a cover covering the core, wherein the inner core has a flexural rigidity of 20 to 80 MPa, a ratio ($R_M/R_I$) of a flexural rigidity of the intermediate layer ($R_M$) to that of the inner core ($R_I$) is within the range of 0.6 to 1.4, a flexural rigidity of the outer layer is higher than that of the inner core by 70 to 500 MPa, and assuming that a radius of the golf ball is represented by $r_G$, a radius of the inner core is represented by $r_I$ and a radius of a two-layer structured core obtained by forming the intermediate layer on the inner core is represented by $r_T$, the intermediate layer is placed such that the $r_G$, $r_I$ and $r_T$ satisfy the following two formulae:

$$r_I/r_G \geqq 0.70$$

$$r_T/r_G \leqq 0.83$$

In the golf ball comprising a core and a cover, the present inventors have studied flexural rigidity of the core and backspin amount of the resulting golf ball. As a result, it is apparent that the flexural rigidity has the smallest effect on the backspin amount in a layer placed within a range that a distance from the center point of the golf ball is from 70 to 83% based on the radius of the golf ball, when compared with the other position. In the golf ball of the present invention, the core is formed so as to have a three-layered structure consisting of a inner core, an intermediate layer and an outer layer; and the intermediate layer is placed such that the a radius of the golf ball ($r_G$), a radius of the inner core ($r_I$) and a radius of a two-layer structured core obtained by forming the intermediate layer on the inner core ($r_T$) satisfy the following two formulae:

$$r_I/r_G \geqq 0.70$$

$$r_T/r_G \leqq 0.83$$

Therefore, when the flexural rigidity of the inner core placed at the inner portion of the intermediate layer is low, the backspin amount of the resulting golf ball is small. On the other hand, when the flexural rigidity of the inner core is high, the backspin amount of the resulting golf ball is large. In addition, when the flexural rigidity of the outer layer placed at the outer portion of the intermediate layer is high, the backspin amount of the resulting golf ball is small. On the other hand, when the flexural rigidity of the outer layer is low, the backspin amount of the resulting golf ball is large.

In the golf ball of the present invention, the flexural rigidity of the inner core is adjusted to the range of 20 to 80 MPa (When the flexural rigidity of the inner core is higher than 80 MPa, the backspin amount of the resulting golf ball is large.), and the flexural rigidity of the outer layer is adjusted so as to be higher than that of the inner core by 70 to 400 MPa (When the flexural rigidity difference between the inner core and outer layer is less than 70 MPa, the technical effects of restraining the backspin amount is not sufficiently obtained). It is accomplished to reduce the backspin amount of the resulting golf ball by lowering the flexural rigidity of the inner core placed at the inner portion of the intermediate layer having the smallest effect on the backspin amount and heightening the flexural rigidity of the outer layer placed at the outer portion of the intermediate layer.

In the golf ball of the present invention, since the flexural rigidity has the smallest effect on the backspin amount in the intermediate layer, when compared with the other position, as described above, the shot feel of the resulting golf ball is good by adjusting the flexural rigidity of the intermediate layer when compared with a layer other than the intermediate layer, particularly the inner core. Good shot feel is accomplished without having effect on the backspin amount by adjusting the flexural rigidity of the intermediate layer ($R_M$) to the range of the flexural rigidity of the inner core ($R_I$)±40%. Therefore, in the present invention, a multi-piece solid golf ball having excellent flight performance accomplished by small backspin amount and having good shot feel can be accomplished.

In order to put the present invention into a more suitable practical application, it is preferable that the intermediate layer have a thickness of 0.5 to 2.7 mm, and the inner core have a flexural rigidity of 30 to 80 MPa;

the flexural rigidity of the outer layer be higher than that of the inner core by 70 to 150 MPa; and the inner core have a flexural rigidity of 50 to 80 MPa, the intermediate layer have a thickness of 0.8 to 2.0 mm, and the outer layer have a flexural rigidity of 120 to 500 MPa.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 5 consisting of an inner core 1 and, an intermediate layer 2 formed on the inner core and an outer layer 3 formed on the intermediate layer, and a cover 4 covering the core.

The inner core 1, intermediate layer 2 and outer layer 3 of the golf ball of the present invention may be formed from vulcanized molded article of rubber composition containing cis-1,4-polybutadiene as a main component, and may be obtained by mixing a rubber composition using a mixer such as a mixing roll, and then vulcanizing and press-molding under applied heat the rubber composition in a mold. The rubber composition comprises 3 to 20 parts by weight in the inner core, 20 to 35 parts by weight in the intermediate layer, 35 to 50 parts by weight in the outer layer of a vulcanizing agent (crosslinking agent), for example, α,β-unsaturated carboxylic acid (such as acrylic acid, methacrylic acid, etc.) or mono or divalent metal salts, such as zinc or magnesium salts thereof, or a functional monomer such as trimethylolpropane trimethacrylate, or a combination thereof;

0.5 to 5 parts by weight of co-crosslinking initiator such as organic peroxides;

4 to 20 parts by weight of filler such as zinc oxide, barium sulfate and the like; and optionally 0.5 to 5 parts by weight of organic sulfide compound, antioxidant and the like, based on 100 parts by weight of the polybutadiene rubber. The amount of the co-crosslinking initiator is preferably 0.7 to 4 parts by weight, the amount of the filler is preferably 5 to 18 parts by weight, the amount of the organic sulfide compound, antioxidant and the like is preferably 0.7 to 4 parts by weight, based on the 100 parts by weight of the polybutadiene rubber. However, such inner core 1, intermediate layer 2 and outer layer 3 are given by way of illustrative examples only, and the invention shall not be limited thereto.

The inner core 1 used for the golf ball of the present invention is obtained by uniformly mixing the above rubber composition, and then vulcanizing and press-molding under applied heat the mixture in a mold. The vulcanization may be conducted, for example, by press molding at 130 to 240° C. and 2.9 to 9.8 MPa for 15 to 60 minutes.

In the golf ball of the present invention, the inner core 1 has a diameter of 29.5 to 35.5 mm, preferably 29.5 to 33.0 mm, more preferably 30.0 to 31.4 mm. When the diameter of the inner core is smaller than 29.5 mm, the spin amount at the time of hitting of the resulting golf ball is large, and the hit golf ball creates blown-up trajectory, which reduces the flight distance. On the other hand, when the diameter of the inner core is larger than 35.5 mm, the resulting golf ball is too soft, and it is difficult to obtain the desired hardness, which degrades the rebound characteristics. In addition, the shot feel is poor such that rebound characteristics are poor.

In the golf ball of the present invention, it is required for the inner core 1 to have a flexural rigidity of 20 to 80 MPa, preferably 30 to 80 MPa, more preferably 50 to 80 MPa. When the flexural rigidity of the inner core 1 is lower than 20 MPa, the rebound characteristics are degraded, which reduces the flight distance. On the other hand, when the flexural rigidity is higher than 80 MPa, the shot feel is hard and poor. In addition, the spin amount at the time of hitting is large, and the hit golf ball creates blown-up trajectory, which reduces the flight distance.

The intermediate layer 2 is then formed on the inner core 1. A method of covering the inner core 1 with the intermediate layer 2 is not specifically limited, but may be conventional methods, which have been known to the art and used for forming the two-layer structured core of the golf balls. For example, there can be used a method comprising uniformly mixing the composition for the intermediate layer, coating on the inner core 1 into a concentric sphere, followed by pressure molding in a mold at 130 to 180° C. for 10 to 40 minutes; or a method comprising molding the composition for the intermediate layer into a semi-spherical half-shell in advance, covering the inner core 1 with the two half-shells, followed by pressure molding at 130 to 180° C. for 10 to 40 minutes.

In the golf ball of the present invention, it is required for the intermediate layer 2 to be placed such that the a radius of the golf ball ($r_G$), a radius of the inner core ($r_I$) and a radius of a two-layer structured core obtained by forming the intermediate layer on the inner core ($r_T$) satisfy the following two formulae:

$$r_I/r_G \geqq 0.70$$

$$r_T/r_G \leqq 0.83$$

preferably $$r_I/r_G > 0.74$$

$$r_T/r_G < 0.78$$

When the intermediate layer 2 is placed at the inner portion than the position that the ($r_I/r_G$) is 0.7, the spin amount at the time of hitting is large. On the other hand, when the intermediate layer 2 is placed at the outer portion than the position that the ($r_T/r_G$) is 0.83, it has great effect on the spin amount at the tome of hitting.

In the golf ball of the present invention, it is required that a ratio ($R_M/R_I$) of a flexural rigidity of the intermediate layer ($R_M$) to that of the inner core ($R_I$) be within the range of 0.6 to 1.4, preferably 1.0 to 1.4. When the ratio ($R_M/R_I$) is smaller than 0.6, the shot feel is too soft and poor. On the other hand, when the ratio ($R_M/R_I$) is larger than 1.4, the shot feel is too hard and poor.

In the golf ball of the present invention, it is desired for the intermediate layer 2 to have a thickness of 0.3 to 2.8 mm, preferably 0.5 to 2.7 mm, more preferably 0.8 to 2.7 mm. When the thickness of the intermediate layer 2 is smaller than 0.3 mm, since the outer layer is formed from hard material, the shot feel of the resulting golf ball is hard and poor. On the other hand, when the thickness of the intermediate layer 2 is larger than 2.8 mm, the rebound characteristics are degraded, which reduces the flight distance.

In the golf ball of the present invention, the outer layer 3 is then formed on the intermediate layer 2 to form a core 5 having three-layered structure. A method of covering the intermediate layer 2 with the outer layer 3 is not specifically limited, but may be the same method as the method of covering the inner core 1 with the intermediate layer 2.

In the golf ball of the present invention, it is desired for the outer layer 3 to have a thickness of 1.5 to 3.5 mm, preferably 2.2 to 3.2 mm. When the thickness of the outer layer 3 is smaller than 1.5 mm, since the intermediate layer is formed from soft material, the core is too soft, and it is difficult to obtain a desired hardness of the resulting golf ball. On the other hand, when the thickness of the outer layer is larger than 3.5 mm, the shot feel of the resulting golf ball is hard and poor.

In the golf ball of the present invention, it is required that a flexural rigidity of the outer layer be higher than that of the inner core by 70 to 500 MPa, and the flexural rigidity difference between the outer layer and inner core be preferably 70 to 150 MPa, more preferably 70 to 120 MPa. When the flexural rigidity difference is lower than 70 MPa, the spin amount at the time of hitting is large, which reduces the flight distance. On the other hand, when the flexural rigidity difference is higher than 500 MPa, the shot feel of the resulting golf ball is hard and poor. In addition, the durability of the resulting golf ball is poor.

In the golf ball of the present invention, it is desired for the outer layer 3 to have a flexural rigidity of 120 to 500 MPa, preferably 120 to 180 MPa. When the flexural rigidity of the outer layer 3 is smaller than 120 MPa, the spin amount at the time of hitting is large, which reduces the flight distance. On the other hand, when the flexural rigidity of the outer layer 3 is larger than 500 MPa, the shot feel of the resulting golf ball is hard and poor. A flexural rigidity of the inner core 1, intermediate layer 2 and outer layer 3 as used herein means a flexural rigidity determined by measuring a flexural rigidity according to JIS K7106 using a sample of a heat and press molded sheet having a thickness of about 2 mm from each layer composition, which had been stored at 23° C. for 2 weeks.

In the golf ball of the present invention, the core 5 has a diameter of 38.0 to 41.7 mm, preferably 39.5 to 41.7 mm, more preferably 39.8 to 41.1 mm. When the diameter of the core is smaller than 38.0 mm, the spin amount is large in the flexural rigidity distribution that the outer layer has high flexural rigidity, which reduces the flight distance. On the other hand, when the diameter of the core is larger than 41.7 mm, the diameter of the golf ball after molding the cover is too large, and air resistance is large, which reduces the flight distance.

In the golf ball of the present invention, the core 5 comprising the inner core 1, intermediate layer 2 and outer layer 3 are formed by press-molding under applied heat the rubber composition comprising cis-1, 4-polybutadiene rubber as a main component. Since the core 5, which is not formed from thermoplastic resin, such as ionomer resin, thermoplastic elastomer, diene copolymer and the like, is formed from the press-molded article of the rubber composition as described above, the rebound characteristics are improved and the shot feel is good. Since the inner core 1, the intermediate layer 2 and the outer layer 3 are formed from the same vulcanized rubber composition, the adhesion between each layer in the core 5 and the contiguous layer is excellent, and the durability is improved. Rubber, when compared with resin, has a little deterioration of performance at low temperature lower than room temperature as known in the art, and thus the core 5 of the present invention formed from the rubber has excellent rebound characteristics at low temperature.

The cover 4 is then covered on the core 5. In the golf ball of the present invention, it is desired for the cover 4 to have a thickness of 0.5 to 2.3 mm, preferably 0.5 to 1.6 mm, more preferably 0.8 to 1.5 mm. When the thickness is smaller than 0.5 mm, the durability of the resulting golf ball is poor. On the other hand, when the thickness is larger than 2.3 mm, the spin amount at the time of hitting is large, which reduces the flight distance.

As the materials used in the cover of the present invention, preferred is polyurethane-based thermoplastic elastomer in view of scuff resistance, and particularly preferred is polyurethane-based thermoplastic elastomer formed by using cycloaliphatic diisocyanate in view of rebound characteristics, scuff resistance and yellowing resistance. Examples of the cycloaliphatic diisocyanates include one or combination of two or more selected from the group consisting of 4,4'-dicyclohexylmethane diisocyanate ($H_{12}$MDI), which is hydrogenated compound of 4,4'-diphenylmethane diisocyanate (MDI); 1,3-bis (isocyanatomethyl) cyclohexane ($H_6$XDI), which is hydrogenated compound of xylylene diisocyanate (XDI); isophorone diisocyanate (IPDI); and trans-1,4-cyclohexane diisocyanate (CHDI). Preferred is the $H_{12}$MDI in view of general-purpose properties and processability. Concrete examples of the polyurethane-based thermoplastic elastomer formed by using the $H_{12}$MDI include polyurethane-based thermoplastic elastomers, which are commercially available from BASF Japan Co., Ltd. under the trade name of "Elastollan XNY585", "Elastollan XNY90A", "Elastollan XNY97A", and the like.

As the materials suitably used in the cover 4 of the present invention, the above polyurethane-based thermoplastic elastomer may be used alone, but the polyurethane-based thermoplastic elastomer may be used in combination with at least one of the other thermoplastic elastomer, diene-based block copolymer, ionomer resin and the like. Examples of the other thermoplastic elastomers include the other polyurethane-based thermoplastic elastomer, polyamide-based thermoplastic elastomer, polyester-based thermoplastic elastomer, styrene-based thermoplastic elastomer, polyolefin-based thermoplastic elastomer and the like. The other thermoplastic elastomer may have functional group, such as carboxyl group, glycidyl group, sulfone group, epoxy group and the like.

Concrete examples of the other thermoplastic elastomers include polyurethane-based elastomer, which is commercially available from BASF Japan Co., Ltd. under the trade name of "Elastollan" (such as "Elastollan ET880"); polyamide-based thermoplastic elastomer, which is commercially available from Atofina Japan Co., Ltd. under the trade name of "Pebax" (such as "Pebax 2533"); polyester-based thermoplastic elastomer, which is commercially available from Toray-Du Pont Co., Ltd. under the trade name of "Hytrel" (such as "Hytrel 3548", "Hytrel 4047"); styrene-based thermoplastic elastomer available from Asahi Kasei corporation under the trade name "Tuftec" (such as "Tuftec H1051"); olefin-based thermoplastic elastomer available from Mitsubishi Chemical Co., Ltd. under the trade name "Thermoran" (such as "Thermoran 3981N"); polyolefin-based thermoplastic elastomer, which is commercially available from Sumitomo Chemical Co., Ltd. under the trade name of "Sumitomo TPE" (such as "Sumitomo TPE3682" and "Sumitomo TPE9455"); and the like.

The diene-based block copolymer is a block copolymer or partially hydrogenated block copolymer having double bond derived from conjugated diene compound. The base block copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene-based block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene-based block copolymers which are commercially available include the diene-based block copolymers, which are commercially available from Daicel Chemical Industries, Ltd. under the trade name of "Epofriend" (such as "Epofriend A1010"), the diene-based block copolymers, which are commercially available from Kuraray Co., Ltd. under the trade name of "Septon" (such as "Septon HG-252") and the like.

The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn 6320 and the like. Examples of the ionomer resins, which are commercially available from Exxon Chemical Co., include Iotek 7010, Iotek 8000 and the like. These ionomer resins may be used alone or in combination.

The amount of the other thermoplastic elastomer, diene-based block copolymer or ionomer resin is 0 to 40 parts by weight, preferably 0 to 30 parts by weight, based on 100 parts by weight of the base resin for the cover. When the amount is larger than 40 parts by weight, either scuff resistance, rebound characteristics or yellowing resistance are degraded.

The composition for the cover 4 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component as long as the addition of the additives does not deteriorate the desired performance of the golf ball cover. If used, the amount of the pigment is preferably 0.1 to 5.0 parts by weight, based on 100 parts by weight of the base resin for the cover.

A method of covering on the core 5 with the cover 4 is not specifically limited, but may be a conventional method. For example, there can be used a method comprising molding the cover composition into a semi-spherical half-shell in advance, covering the core with the two half-shells, followed by press molding at 130 to 170° C. for 1 to 5 minutes, or a method comprising injection molding the cover composition directly on the core, which is covered with the cover, to cover it. At the time of molding the cover, many depressions called "dimples" are formed on the surface of the golf ball. Furthermore, paint finishing or marking with a stamp may be optionally provided after the cover is molded for commercial purposes. The golf ball of the present invention is formed, so that it has a diameter of not less than 42.67 mm (preferably 42.67 to 42.82 mm) and a weight of not more than 45.93 g, in accordance with the regulations for golf balls.

The diameter of golf balls is limited to not less than 42.67 mm in accordance with the regulations for golf balls as described above. Generally, when the diameter of the golf ball is large, air resistance of the golf ball on the fly is large, which reduces the flight distance. Therefore, most of golf balls commercially available are designed to have a diameter of 42.67 to 42.82 mm. The present invention is applicable to the golf balls having the diameter. There are golf balls having large diameter in order to improve the easiness of hitting. In addition, there are cases where golf balls having a diameter out of the regulations for golf balls are required depending on the demand and object of users. Therefore, it can be considered for golf balls to have a diameter of 42 to 44 mm, more widely 40 to 45 mm. The present invention is also applicable to the golf balls having the diameter.

EXAMPLES

The following Examples and Comparative Examples further illustrate the present invention in detail but are not to be construed to limit the scope of the present invention.

(1) Production of Core (i) Production of Inner Core

The rubber compositions A and B having the formulation shown in Table 1 were mixed, and the mixtures were then press-molded at 170° C. for 15 minutes in the mold to obtain spherical inner core. The diameter and flexural rigidity ($R_I$) of the resulting inner core were measured, and the results are shown in Table 4 (Examples) and Table 5 (Comparative Examples). A ratio ($r_I/r_G$) of the radius of the inner core ($r_I$) to that of the golf ball ($r_G$) was determined by calculation, and the results are shown in the same Tables.

(ii) Formation of Intermediate Layer

The rubber compositions C to G having the formulation shown in Tables 1 and 2 was mixed, and coated on the inner core produced in the step (i) into a concentric sphere, and then vulcanized by press-molding at 170° C. for 15 minutes in the mold to form intermediate layer on the inner core and obtain spherical molded article having a two-layered structure. The thickness and flexural rigidity ($R_M$) of the resulting intermediate layer were measured, and the results are shown in Table 4 (Examples) and Table 5 (Comparative Examples). A ratio ($r_T/r_G$) of the radius of the spherical molded article having a two-layered structure ($r_T$) to that of the golf ball ($r_G$) and the flexural rigidity ratio ($R_M/R_I$) were determined by calculation, and the results are shown in the same Tables.

(iii) Formation of Outer Layer

The rubber compositions F and H having the formulation shown in Table 2 were mixed, and coated on the two-layer structured spherical molded article produced in the step (ii) into a concentric sphere, and then vulcanized by press-molding at 170° C. for 15 minutes in the mold to form outer layer on the two-layer structured spherical molded article and obtain three-layer structured core. having a diameter of 41.2 mm and a weight of 41.1 g. The thickness and flexural rigidity ($R_O$) of the resulting outer layer were measured, and the results are shown in Table 4 (Examples) and Table 5 (Comparative Examples). The flexural rigidity difference ($R_O-R_I$) was determined by calculation from the flexural rigidity value.

TABLE 1

| | (parts by weight) | | | |
|---|---|---|---|---|
| Core composition | A | B | C | D |
| BR11 *1 | 100 | 100 | 100 | 100 |
| Zinc acrylate | 27.5 | 31.5 | 31.5 | 33.5 |
| Zinc oxide | 5 | 5 | 5 | 5 |
| Barium sulfate | 9.7 | 8.1 | 8.1 | 7.3 |
| Dicumyl peroxide | 0.8 | 0.8 | 0.7 | 0.7 |
| Diphenyl disulfide | 0.5 | 0.5 | 0.5 | 0.5 |

TABLE 2

| | (parts by weight) | | | |
|---|---|---|---|---|
| Core composition | E | F | G | H |
| BR11 *1 | 100 | 100 | 100 | 100 |
| Zinc acrylate | 20 | 37 | 15 | 41 |
| Zinc oxide | 5 | 5 | 5 | 5 |
| Barium sulfate | 12.3 | 5.8 | 4.3 | 4.1 |
| Dicumyl peroxide | 0.7 | 0.7 | 0.7 | 0.7 |
| Diphenyl disulfide | 0.5 | 0.5 | 0.5 | 0.5 |

*1: High-cis Polybutadiene rubber, commercially available from JSR Co., Ltd. under the trade name of "BR-11" (Content of 1,4-cis-polybutadiene: 96%)

(2) Preparation of Cover Compositions

The formulation materials showed in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 160 to 260° C. at the die position of the extruder.

TABLE 3

| Cover composition | Amount (parts by weight) |
|---|---|
| Elastollan XNY97A *2 | 100 |
| Titanium dioxide | 4 |

*2: Elastollan XNY97A (trade name), polyurethane - based thermoplastic elastomer formed by using 4,4'-dicyclohexylmethane diisocyanate ($H_{12}MDI$), commercially available from BASF Polyurethane Elastomers Co., Ltd.; Shore A (JIS-A) hardness = 97

Examples 1 to 5 and Comparative Examples 1 to 4

The cover compositions produced in the step (2) were covered on the resulting three-layer structured core produced in the step (iii) by injection molding to form a cover layer having a thickness of 1.45 mm. Then, clear paint was applied on the surface to produce golf ball having a diameter of 42.7 mm (radius of 21.35 mm). With respect to the resulting golf balls, the flight performance (launch angle, spin amount and flight distance) and shot feel were measured or evaluated. The results are shown in the Tables 6 and 7. The test methods are as follows.

(Test Methods)

(1) Flexural Rigidity

The rubber compositions for each layer of the core were press-molded at 170° C. for 15 minutes in the mold for molding sheet to prepare heat and press molded sheet (slab) having a thickness of about 2 mm. The flexural rigidity was determined according to JIS K 7106, using a sample of the heat and press molded sheet, which had been stored at 23° C. for 2 weeks.

(2) Flight Distance

After a No. 1 wood club (a driver, W#1; "XXIO" loft angle=10 degrees, S shaft, manufactured by Sumitomo Rubber Industries, Ltd.) having metal head was mounted to a swing robot manufactured by Golf Laboratory Co. and a golf ball was hit at head speed of 45 m/sec, the launch angle and spin amount (backspin amount) immediately after hitting and flight distance were measured. As the flight distance, total that is a distance to the stop point of the hit golf ball was measured. The measurement was conducted 12 times (n=12) for each golf ball, and the average is shown as the result of the golf ball.

(3) Shot Feel

The shot feel of the golf ball is evaluated by 10 golfers according to a practical hitting test using a No. 1 wood club (W#1, a driver) having metal head. The evaluation criteria are as follows. The results shown in the Tables below are based on the fact that the most golfers evaluated with the same criterion about shot feel.

o: The golfers felt that the golf ball has good shot feel such that the impact force at the time of hitting is small x(H) The golfers felt that the golf ball has hard and poor shot feel such that the impact force at the time of hitting is large.

x(S): The golfers felt that the golf ball has too soft and poor shot feel.

(Test Results)

TABLE 4

| Test item | Example No. 1 | 2 | 3 | 4 | 5 |
|---|---|---|---|---|---|
| (Inner core) | | | | | |
| Composition | A | A | A | A | B |
| Diameter (mm) | 30 | 30 | 30 | 31.4 | 31.4 |
| Ratio of radius $r_I/r_G$ (%) | 70.3 | 70.3 | 70.3 | 73.5 | 73.5 |
| Flexural rigidity $R_I$ (MPa) | 58 | 58 | 58 | 58 | 78 |
| (Intermediate layer) | | | | | |
| Composition | C | D | E | D | D |
| Thickness (mm) | 2.7 | 2.7 | 2.7 | 1.0 | 1.0 |
| Ratio of radius $r_T/r_G$ (%) | 82.9 | 82.9 | 82.9 | 78.2 | 78.2 |
| Flexural rigidity $R_M$ (MPa) | 78 | 80 | 35 | 80 | 80 |
| (Outer layer) | | | | | |
| Composition | F | H | H | H | H |
| Thickness (mm) | 2.2 | 2.2 | 2.2 | 3.2 | 3.2 |
| Flexural rigidity $R_O$ (MPa) | 127 | 177 | 177 | 177 | 177 |
| Ratio ($R_M/R_I$) | 1.34 | 1.38 | 0.60 | 1.38 | 1.03 |
| Difference ($R_O - R_I$) | 69 | 119 | 119 | 119 | 99 |

TABLE 5

| Test item | Comparative Example No. 1 | 2 | 3 | 4 |
|---|---|---|---|---|
| (Inner core) | | | | |
| Composition | A | A | A | A |
| Diameter (mm) | 30 | 30 | 20 | 36 |
| Ratio of radius $r_I/r_G$ (%) | 70.3 | 70.3 | 46.8 | 84.3 |
| Flexural rigidity $R_I$(MPa) | 58 | 58 | 58 | 58 |
| (Intermediate layer) | | | | |
| Composition | F | G | C | C |
| Thickness (mm) | 2.7 | 2.7 | 2.7 | 1.0 |
| Ratio of radius $r_T/r_G$ (%) | 82.9 | 82.9 | 59.5 | 89.0 |
| Flexural rigidity $R_M$(MPa) | 127 | 20 | 78 | 78 |
| (Outer layer) | | | | |
| Composition | F | F | F | F |
| Thickness (mm) | 2.2 | 2.2 | 7.2 | 0.9 |
| Flexural rigidity $R_O$(MPa) | 127 | 127 | 127 | 127 |
| Ratio ($R_M/R_I$) | 2.19 | 0.34 | 1.34 | 1.34 |
| Difference ($R_O - R_I$) | 69 | 69 | 69 | 69 |

TABLE 6

| Test item | Example No. 1 | 2 | 3 | 4 | 5 |
|---|---|---|---|---|---|
| Flight performance (W#1; 45 m/sec) | | | | | |
| Launch angle (degree) | 10.9 | 11.2 | 11.1 | 11.4 | 11.4 |
| Spin amount (rpm) | 3050 | 2940 | 2960 | 2900 | 2920 |
| Total (m) | 219.0 | 221.7 | 221.8 | 222.8 | 222.7 |
| Shot feel | ○ | ○ | ○ | ○ | ○ |

TABLE 7

| Test item | Comparative Example No. 1 | 2 | 3 | 4 |
|---|---|---|---|---|
| Flight performance (w#1; 45 m/sec) | | | | |
| Launch angle (degree) | 10.8 | 11.0 | 9.5 | 9.6 |
| Spin amount (rpm) | 3070 | 3040 | 3200 | 3180 |
| Total (m) | 218.3 | 218.2 | 214.0 | 214.9 |
| Shot feel | x (H) | x (S) | x (H) | x (S) |

As is apparent from Tables 6 to 7, the golf balls of Examples 1 to 5 of the present invention, when compared with the golf balls of Comparative Examples 1 to 4, have long flight distance by accomplishing high launch angle and low spin amount, and have good shot feel.

On the other hand, in the golf ball of Comparative Example 1, since the flexural rigidity ratio ($R_M/R_I$) is large, the shot feel is hard and poor. In the golf ball of Comparative Example 2, since the flexural rigidity ratio ($R_M/R_I$) is small, the shot feel is too soft and poor.

In the golf ball of Comparative Example 3, since the ratio of the radius in the inner core and the ratio of the radius in the intermediate layer are small and the intermediate layer is placed at the inner portion, the outer layer having high flexural rigidity is placed at the inner portion of the golf ball, and the spin amount is large, which reduces the flight distance. In the golf ball of Comparative Example 4, since the ratio of the radius in the inner core and the ratio of the radius in the intermediate layer are large and the intermediate layer is placed at the outer portion of the golf ball, the spin amount is large, which reduces the flight distance.

What is claimed is:

1. A multi-piece solid golf ball comprising a core consisting of an inner core, an intermediate layer formed on the inner core and an outer layer formed on the intermediate layer, and a cover covering the core, wherein the inner core has a flexural rigidity of 20 to 80 MPa, a ratio ($R_M/R_I$) of a flexural rigidity of the intermediate layer ($R_M$) to that of the inner core ($R_I$) is within the range of 0.6 to 1.4, a flexural rigidity of the outer layer is higher than that of the inner core by 70 to 500 MPa, and assuming that a radius of the golf ball is represented by $r_g$, a radius of the inner core is represented by $r_I$ and a radius of a two-layer structured core obtained by forming the intermediate layer on the inner core is represented by $r_T$, the intermediate layer is placed such that the $r_G$, $r_I$ and $r_T$ satisfy the following two formulae:

$$r_I/r_G \geqq 0.70$$

$$r_T/r_G \leqq 0.83.$$

2. The multi-piece solid golf ball according to claim 1, wherein the intermediate layer has a thickness of 0.5 to 2.7 mm, and the inner core has a flexural rigidity of 30 to 80 MPa.

3. The multi-piece solid golf ball according to claim 1, wherein the flexural rigidity of the outer layer is higher than that of the inner core by 70 to 150 MPa.

4. The multi-piece solid golf ball according to claim 1, wherein the inner core has a flexural rigidity of 50 to 80 MPa, the intermediate layer has a thickness of 0.8 to 2.0 mm, and the outer layer has a flexural rigidity of 120 to 500 MPa.

5. The multi-piece solid golf ball according to claim 1, wherein $r_G$, $r_I$ and $r_T$ satisfy the following two formulae:

$$r_I/r_G \geqq 0.74$$

$$r_T/r_G \leqq 0.78.$$

6. The multi-piece solid golf ball according to claim 1, wherein the ratio ($R_M/R_I$) of a flexural rigidity of the intermediate layer ($R_M$) to that of the inner core ($R_I$) is within the range of 1.0 to 1.4.

7. The multi-piece solid golf ball according to claim 5, wherein the ratio ($R_M/R_I$) of a flexural rigidity of the intermediate layer ($R_M$) to that of the inner core ($R_I$) is within the range of 1.0 to 1.4.

8. The multi-piece solid golf ball according to claim 2, wherein $r_G$, $r_I$ and $r_T$ satisfy the following two formulae:

$$r_I/r_G \geqq 0.74$$

$$r_T/r_G \leqq 0.78.$$

9. The multi-piece solid golf ball according to claim 2, wherein the ratio ($R_M/R_I$) of a flexural rigidity of the intermediate layer ($R_M$) to that of the inner core ($R_I$) is within the range of 1.0 to 1.4.

10. The multi-piece solid golf ball according to claim 8, wherein the ratio ($R_M/R_I$) of a flexural rigidity of the intermediate layer ($R_M$) to that of the inner core ($R_I$) is within the range of 1.0 to 1.4.

* * * * *